US011396724B2

(12) United States Patent
Yoo et al.

(10) Patent No.: US 11,396,724 B2
(45) Date of Patent: Jul. 26, 2022

(54) BEARING ASSEMBLY AND CLOTHES DRYER HAVING THE SAME

(71) Applicant: SAMSUNG ELECTRONICS CO., LTD., Suwon-si (KR)

(72) Inventors: Seung Wan Yoo, Suwon-si (KR); Sam Young Jang, Suwon-si (KR); Han Kyu Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 362 days.

(21) Appl. No.: 16/680,068

(22) Filed: Nov. 11, 2019

(65) Prior Publication Data

US 2020/0149213 A1 May 14, 2020

(30) Foreign Application Priority Data

Nov. 9, 2018 (KR) ..... 10-2018-0137635

(51) Int. Cl.
*D06F 58/08* (2006.01)
*D06F 58/06* (2006.01)

(52) U.S. Cl.
CPC ..... *D06F 58/08* (2013.01); *D06F 58/06* (2013.01)

(58) Field of Classification Search
CPC ..... D06F 58/08; D06F 58/06
USPC ..... 34/595–610
See application file for complete search history.

(56) References Cited

U.S. PATENT DOCUMENTS

| | | | | |
|---|---|---|---|---|
| 4,025,135 | A | 5/1977 | Hishida | |
| 6,623,167 | B2 | 9/2003 | Bass et al. | |
| 7,523,564 | B2 * | 4/2009 | Doh | D06F 58/06 34/601 |
| 7,748,139 | B2 * | 7/2010 | Hong | F16C 23/04 34/601 |
| 8,272,145 | B2 * | 9/2012 | Yoon | D06F 58/06 384/305 |
| 8,661,707 | B2 * | 3/2014 | Dittmer | D06F 58/04 68/23 R |
| 10,889,933 | B2 * | 1/2021 | Choi | D06F 58/06 |
| 11,028,515 | B2 * | 6/2021 | Lee | D06F 21/14 |
| 2006/0196233 | A1 | 9/2006 | Kim et al. | |
| 2018/0251928 | A1 | 9/2018 | Lee et al. | |
| 2020/0149213 | A1 * | 5/2020 | Yoo | D06F 58/06 |

FOREIGN PATENT DOCUMENTS

| | | | |
|---|---|---|---|
| CN | 1580378 | A | 2/2005 |
| CN | 1902351 | A | 1/2007 |
| CN | 105071584 | A | 11/2015 |

(Continued)

OTHER PUBLICATIONS

Chinese Office Action dated Sep. 27, 2021 for Chinese Application No. 201911093353.X (20 pages).

(Continued)

*Primary Examiner* — Stephen M Gravini
(74) *Attorney, Agent, or Firm* — Staas & Halsey LLP

(57) ABSTRACT

A bearing assembly capable of supporting a shaft of a drum and a clothes dryer having the same. The bearing assembly includes a bearing configured to rotatably support the shaft, and a centering guide formed in an annular shape and in which the bearing is installed, and the bearing assembly having a centering function may be simply manufactured using a bearing that is generally used.

18 Claims, 9 Drawing Sheets

(56) References Cited

FOREIGN PATENT DOCUMENTS

| | | | | | |
|---|---|---|---|---|---|
| EP | 1548176 | B1 | * | 4/2013 | ..... D06F 58/06 |
| EP | 3372723 | B1 | * | 12/2019 | ..... D06F 17/06 |
| JP | 9-219951 | | | 8/1997 | |
| JP | 2005-214314 | | | 8/2005 | |
| JP | 2011-188637 | | | 9/2011 | |
| JP | 4792218 | B2 | * | 10/2011 | ..... D06F 58/06 |
| KR | 10-0925770 | | | 11/2009 | |
| KR | 10-1237040 | | | 2/2013 | |
| KR | 10-1249341 | | | 4/2013 | |
| KR | 10-1686240 | | | 12/2016 | |
| WO | WO-2020096432 | | * | 5/2020 | |

OTHER PUBLICATIONS

International Search Report dated Mar. 11, 2020 in International Patent Application No. PCT/KR2019/015231.

* cited by examiner

BEARING ASSEMBLY AND CLOTHES DRYER HAVING THE SAME

CROSS-REFERENCE TO RELATED APPLICATION(S)

This application is based on and claims priority under 35 U.S.C. § 119 to Korean Patent Application No. 10-2018-0137635, filed on Nov. 9, 2018, in the Korean Intellectual Property Office, the disclosure of which is incorporated by reference herein in its entirety

BACKGROUND

1. Field

The disclosure relates to a clothes dryer, and more particularly, to a bearing assembly capable of supporting a shaft of a drum and a clothes dryer having the same.

2. Description of Related Art

A clothes dryer is a device for drying objects to be dried such as wet clothes, and the clothes dryer is configured to dry objects to be dried by allowing hot air to pass through the inside of a drum while rotating the drum, in which the objects to be dried are placed, at a low speed.

The clothes dryer includes a housing forming an exterior thereof, a drum rotatably installed inside the housing, a driver for driving the drum, and a hot air supplier for supplying hot air into the rotating drum.

When operating the clothes dryer after putting objects to be dried into the drum, the drum is rotated by the operation of the driver and the hot air is supplied to the drum through the hot air supplier, thereby drying the object to be dried in the drum.

The drum includes a shaft installed at the center of the rear side of the housing, and at the rear wall of the housing, a bearing assembly configured to rotatably support the shaft is installed. Therefore, the drum is installed to be rotatable in the housing through the bearing assembly.

SUMMARY

Therefore, it is an aspect of the disclosure to provide a clothes dryer including a bearing assembly capable of allowing a shaft to move in the front, rear, left, and right directions in accordance with a movement of a drum.

Additional aspects of the disclosure will be set forth in part in the description which follows and, in part, will be apparent from the description, or may be learned by practice of the disclosure.

In accordance with an aspect of the disclosure, a clothes dryer includes a housing, a drum configured to be rotatable in the housing, a shaft connected to drum to rotate the drum and installed at the center of a rear wall of the drum, and a bearing assembly configured to rotatably support the shaft, and the bearing assembly includes a bearing configured to rotatably support the shaft, and a centering guide formed in an annular shape and in which the bearing is installed, the centering guide allows an inclination of the shaft to be varied in front, rear, left, and right directions, and the centering guide includes an outer circumferential surface formed with a spherical surface.

The bearing is one of a pair of bearings may be provided in the bearing assembly and the pair of bearings is to be fixed to opposite inner sides of the centering guide.

The centering guide may include a fixing member formed in an annular shape and to which the bearing is fixed, and a guide member formed in an annular shape to allow the fixing member to be fixed therein and provided with an outer circumferential surface formed with a spherical surface.

The fixing member may be formed of a metal material, and the guide member may be formed of a resin material on outside of the fixing member through the insert injection molding method.

The fixing member may include at least one chamfered portion formed by processing a portion of an outer circumferential surface to be a plane.

The fixing member may include a pair of stepped portions formed in a concave shape at axial opposite ends of the outer circumferential surface of the fixing member, and the guide member includes a pair of catching portions formed in a convex shape at axial opposite ends in an inner circumferential surface of the guided member to be caught by the pair of stepped portions.

The bearing assembly may further include a first centering housing and a second centering housing coupled to each other in a front-rear direction and having the centering guide between the first centering housing and the second centering housing so that the centering guide is rotatable inside the coupled first and second centering housings.

The first centering housing may include a first guide portion including an inner circumferential surface formed with a spherical surface corresponding to a front outer circumferential surface of the centering guide, and the second centering housing may include a second guide portion including an inner circumferential surface formed with a spherical surface corresponding to a rear outer circumferential surface of the centering guide.

The first centering housing may include a first flange formed with an annular plate and in which the first guide portion extends from an inner end thereof, and the second centering housing may include a second flange formed with an annular plate and in which the second guide portion extends from an inner end thereof.

The first centering housing may include a first through hole provided in the first flange and a fixing rib extending from an inner end of the first through hole, and the second centering housing may include a second through hole provided on the second flange to correspond to the fixing rib, and the second through hole may be formed to have a diameter larger than that of the fixing rib, and a rear end of the fixing rib may be curled after passing through the second through hole, so as to be supported on the second flange.

The clothes dryer may further include an elastic member arranged between the first and second centering housings to elastically support the centering guide.

The elastic member may include a base portion formed with an annular plate and fitted between the first and second centering housings, and a plurality of elastic portions extending from an inner end of the base portion and spaced apart from each other in the circumferential direction.

The centering guide may include a plurality of locking grooves formed on the outer circumferential surface in the axial direction and spaced apart from each other in the circumferential direction, and the elastic member may further include a plurality of locking portions extending from the inner end of the base portion to be locked by the plurality of locking grooves.

In accordance with another aspect of the disclosure, a bearing assembly includes a bearing configured to rotatably support a shaft, a centering guide formed in an annular shape and in which the bearing is installed, and a first centering housing and a second centering housing coupled to each other in a front-rear direction to receive the centering guide therein and the centering guide being configured to be rotatable therein so that the centering guide allows an inclination of the shaft to be varied in front, rear, left, and right directions, and the centering guide includes an outer circumferential surface formed with a spherical surface, and the first centering housing includes a first guide portion including an inner circumferential surface formed with a spherical surface corresponding to a front outer circumferential surface of the centering guide, and the second centering housing includes a second guide portion including an inner circumferential surface formed with a spherical surface corresponding to a rear outer circumferential surface of the centering guide.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
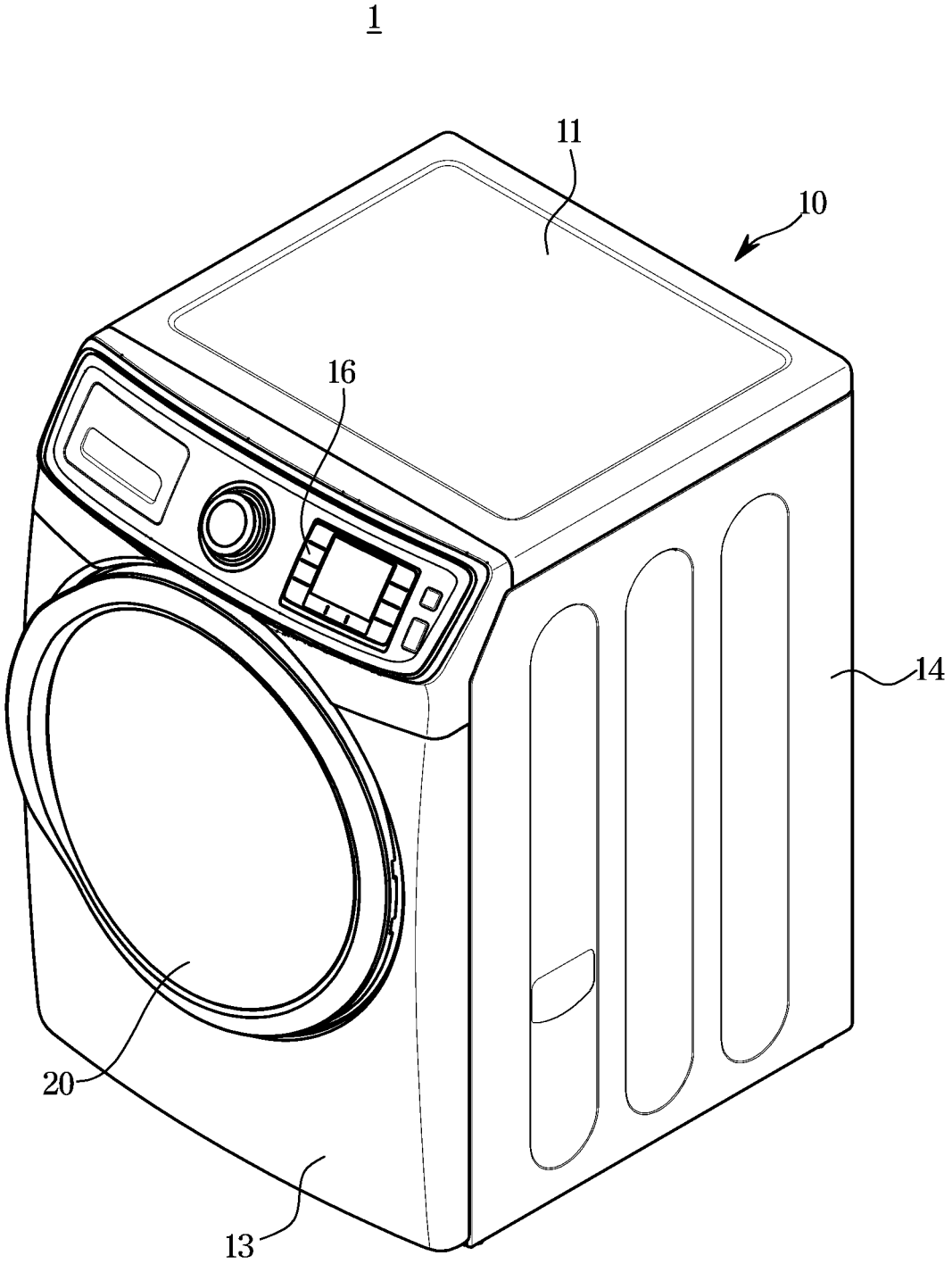
FIG. 1 is a perspective view of a clothes dryer according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

Figure 2:
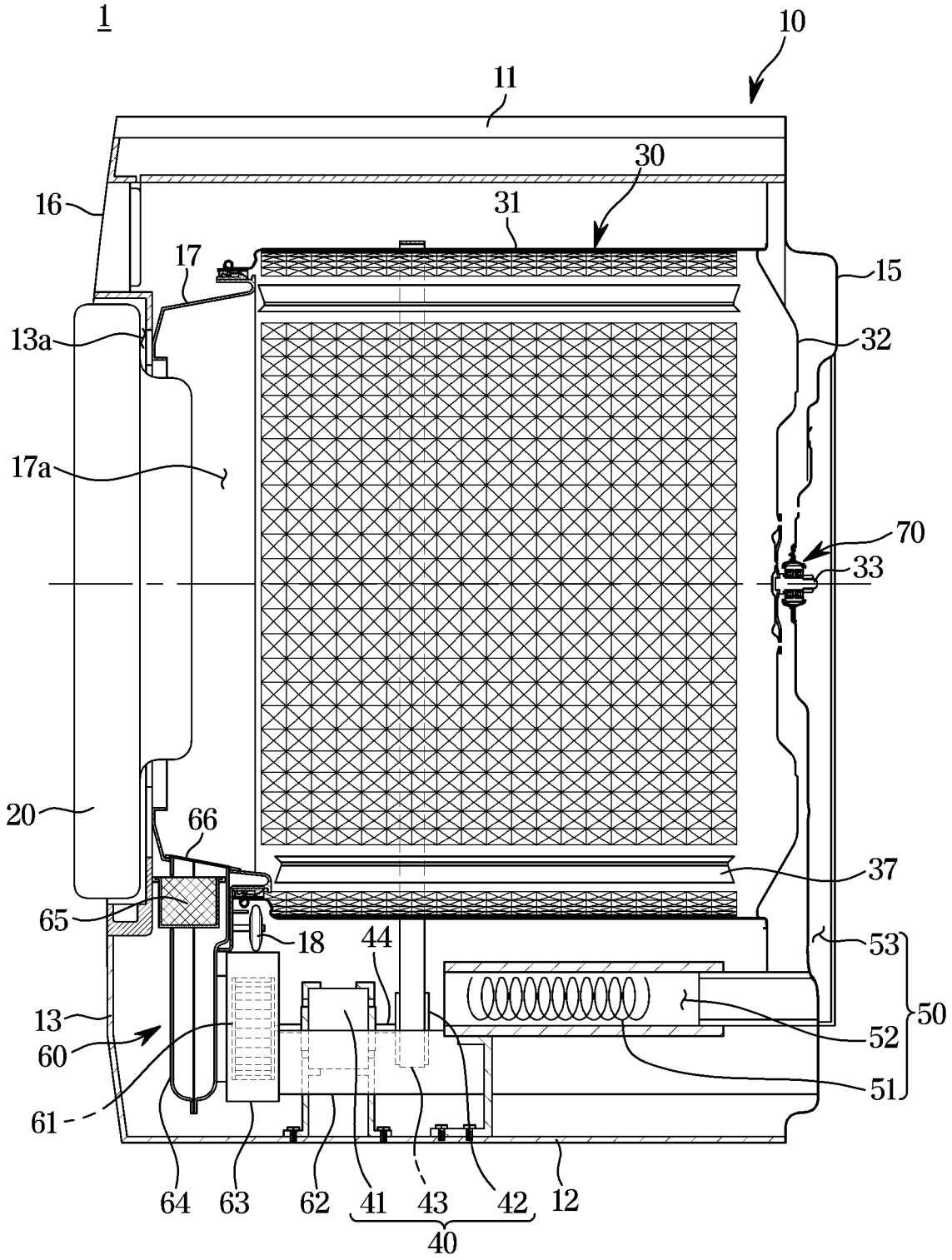
FIG. 2 is a side cross-sectional view of the clothes dryer according to an embodiment of the disclosure.

The disclosure will be described more fully hereinafter with reference to the accompanying drawings FIG. 1 is a perspective view of a clothes dryer according to an embodiment of the disclosure and FIG. 2 is a side cross-sectional view of the clothes dryer according to an embodiment of the disclosure.

As illustrated in FIGS. 1 and 2, a clothes dryer 1 includes a housing 10 forming an exterior, a door 20 configured to open and close an inlet 13*a* provided on the front surface of the housing 10, and a drum 30 rotatably installed in the housing 10 and in which laundry to be dried is placed.

The housing 10 is formed in a substantially box shape. More particularly, the housing 10 includes a top plate 11, a bottom plate 12, a front plate 13, a left side plate (not shown), a right side plate 14, and a rear plate 15.

The housing 10 includes the inlet 13*a* provided on the front plate 13 and configured to allow objects to be dried to be inserted into or taken out from the inside of the drum 30, and a control panel 16 provided on an upper side of the front plate 13 and configured to display a variety of information on the clothes dryer 1 or configured to receive an operation command.

On the inner front side of the housing 10, a front support frame 17 corresponding to an opening of a body 31 to be described later is arranged. As for the front support frame 17, a front end thereof forms a laundry inlet 17*a* corresponding to the above-described inlet 13*a*.

The drum 30 is rotatably coupled to the front support frame 17. The drum 30 includes the body 31 formed in a hollow cylindrical shape with the front and the rear open, and a rear wall 32 configured to cover the rear of the body 31 that is open.

Figure 3:
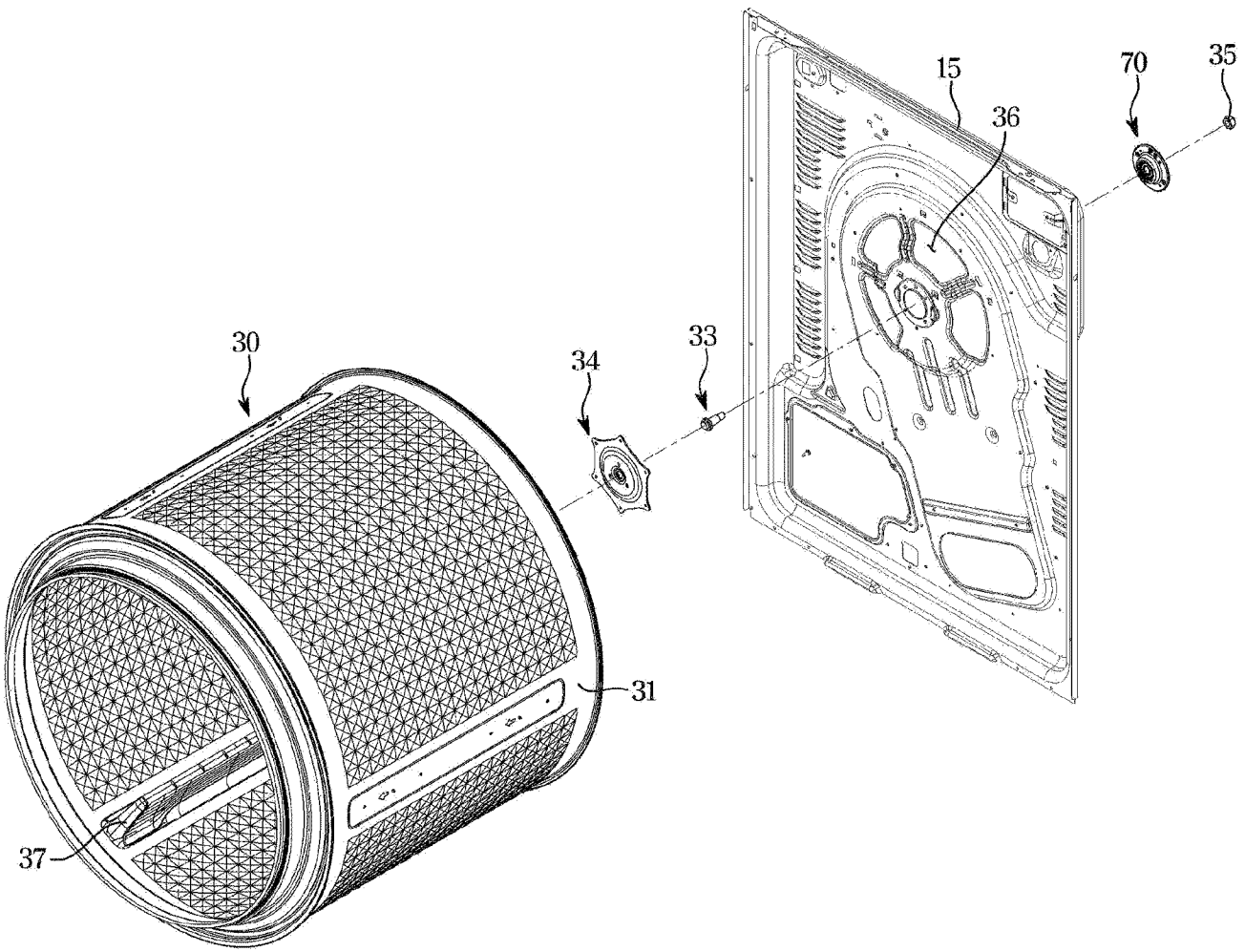
FIG. 3 is an exploded perspective view illustrating a drum, a bearing assembly, and a rear plate of the clothes dryer according to an embodiment of the disclosure.
Figure 4:
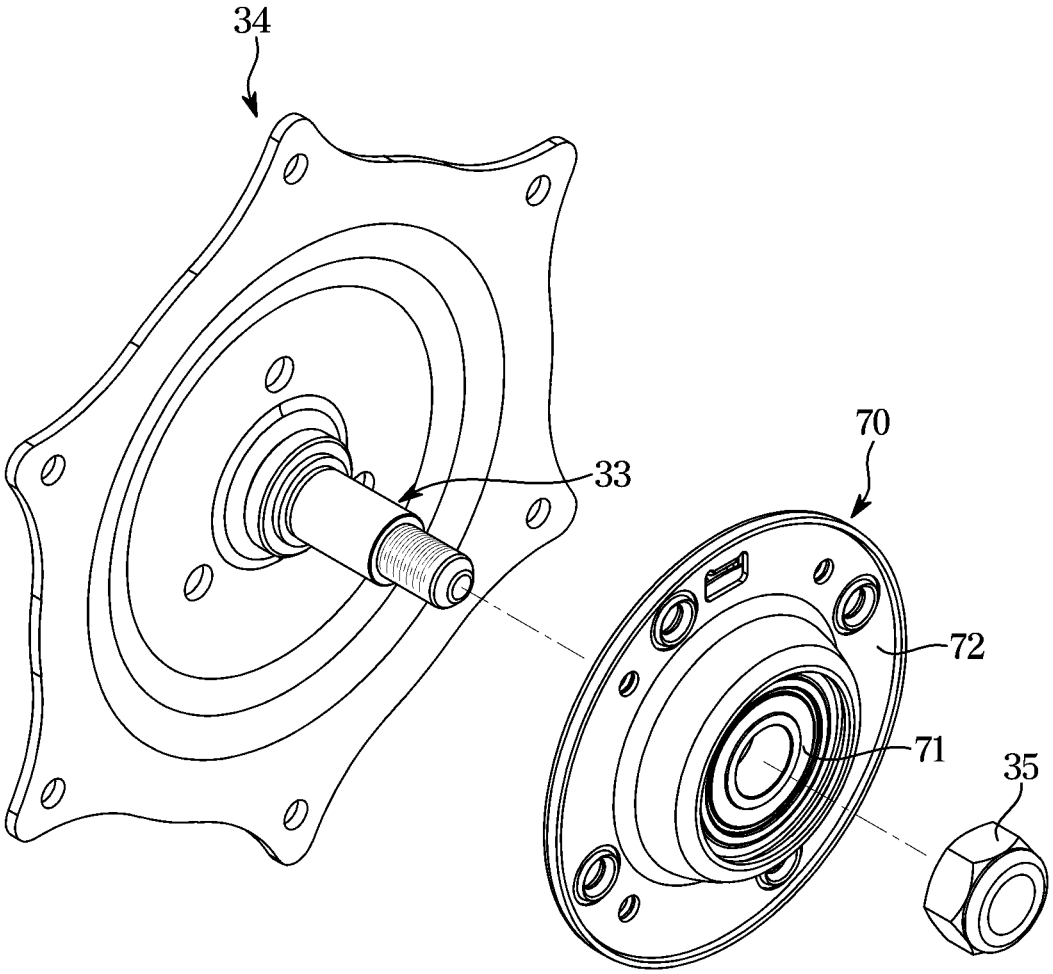
FIG. 4 is an exploded perspective view illustrating the coupling of the shaft and the bearing assembly in the clothes dryer according to an embodiment of the disclosure.

In addition, as illustrated in FIGS. 3 and 4, the drum 30 includes a shaft 33 and a shaft flange 34. In order to allow the drum 30 to be rotatably installed on the rear plate 15, the shaft 33 is installed on the center of the rear wall 32 to form a rotation center of the drum 30. The shaft flange 34 is configured to allow the shaft 33 to be stably fixed to the rear wall 32.

Because the shaft 33 is fixed to the drum 30 through the shaft flange 34 fixed to the rear wall of the drum 30, the shaft 33 rotates together with the drum 30. The shaft flange 34 is fixed to the rear wall 32 of the drum 30 through a plurality fastening members.

Referring again to FIG. 2, the drum 30 includes lifters 37 arranged on an inner circumferential surface of the body 31 to raise the object to be dried upward. A plurality of lifters are spaced apart from each other in the circumferential direction. Therefore, as the drum 30 rotates, the object to be dried may be repeatedly moved upward by the lifters 37 and then dropped. Therefore, as the drum 30 rotates, an unbalanced load is inevitably generated in the drum 30.

As described above, in the process of raising or falling the object to be dried in the drum 30, the unbalanced load is inevitably generated in the drum 30, and the drum 30 is moved due to the unbalanced load.

Therefore, a roller 18 configured to support a lower portion of the front side of the drum 30 is arranged in the housing 10. The roller 18 is arranged in a lower portion of the front side of the housing 10 to allow the drum 30 to rotate smoothly. The arrangement and number of the rollers 18 may vary according to the design specifications.

The clothes dryer 1 further includes a driver 40 for rotating the drum 30.

The driver 40 includes a drive motor 41 installed in the inner lower portion of the housing 10, and a pulley 42 and a belt 43 configured to transmit the power of the drive motor 41 to the drum 30.

The pulley 42 is connected to a motor shaft 44 of the drive motor 41, and thus the pulley 42 is rotated in accordance with the rotation of the drive motor 41.

The belt 43 is installed to be wound on an outer surface of the pulley 42 and an outer surface of the drum 30, and thus the drum 30 is rotated together with the belt 43 as the pulley rotates.

The clothes dryer 1 includes a hot air supplier 50 configured to supply hot air into the drum 30, and a hot air discharger 60 configured to discharge air that has been used for drying the object to be dried in the drum 30.

Therefore, hot air is supplied into the drum 30 by the hot air supplier 50, and the object to be dried in the drum 30 is dried by the supplied hot air. After absorbing the moisture from the object to be dried, the air has a high temperature and a high humidity state, and then the air is discharged to outside through the hot air discharger 60.

The hot air supplier 50 includes a heater 51 configured to heat the suctioned air, and intake ducts 52 and 53 configured to guide the air heated by the heater 51 to flow into the drum 30.

The intake ducts 52 and 53 include the lower intake duct 52 installed under the drum 30, and the rear intake duct 53 installed at the rear of the drum 30 to connect an intake port 36 to the lower intake duct 52. The heater 51 is arranged in the lower intake duct 52 to heat the air suctioned into the lower intake duct 52.

The hot air discharger 60 includes a fan 61 configured to suction high temperature and high humidity air in the drum 30, and an exhaust duct 62 configured to guide the air suctioned by the fan 61 to be discharged from the drum. The fan 61 is placed in a blower case 63. Therefore, the air which absorbed moisture from the object to be dried is discharged to the outside through the exhaust duct 62.

The hot air discharger 60 further includes a filter duct 64 installed in the lower side of the front support frame 17 in such a way that one side of the filter duct 64 communicates with the inside of the drum 30 and the other side thereof communicates with the blower case 63, and a filter 65 installed in the filter duct to filter out foreign substances contained in the air passing through the filter duct 64. The filter 65 is attachable to or detachable from the filter duct 64 so that the filter 65 is removably installed in the filter duct 64.

Air that has dried the object to be dried in the drum 30 may be discharged to the filter duct 64. Foreign substances in the air flowing into the filter duct 64 may be filtered out by the filter 65. A filter grill 66 in the form of a mesh may be installed in an inlet of the filter duct 64.

The drum 30 is rotatably installed on the rear plate 15. More particularly, the shaft 33 of the drum 30 is rotatably installed through a bearing assembly 70 installed on the rear plate 15. Therefore, the drum 30 is rotatably installed on the rear plate 15 through the shaft. The shaft 33 is coupled to the bearing assembly 70 via a nut 35 which is fastened to the rear end thereof.

Figure 5:
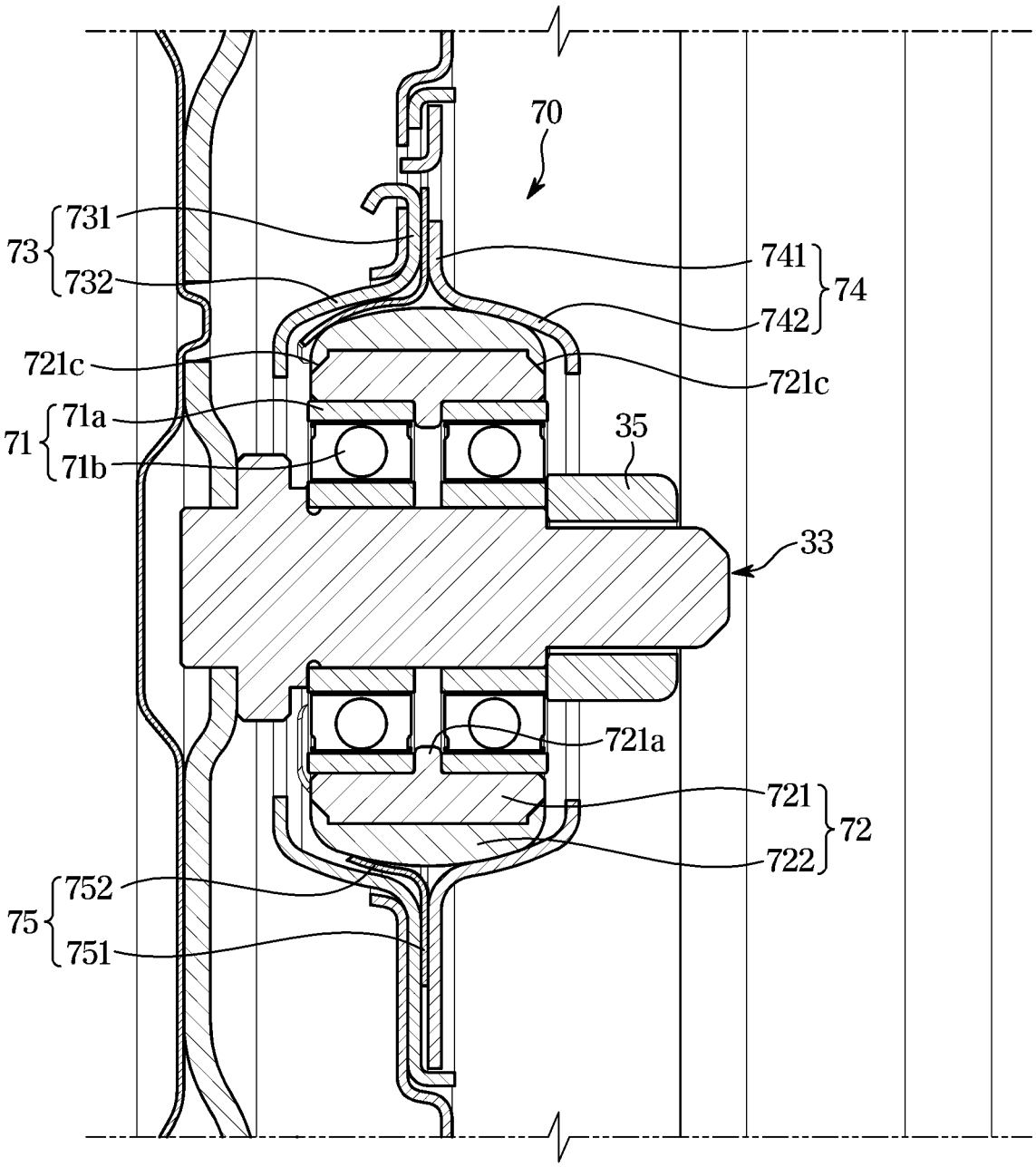
FIG. 5 is a cross-sectional view illustrating the coupling of the shaft and the bearing assembly in the clothes dryer according to an embodiment of the disclosure.
Figure 6:
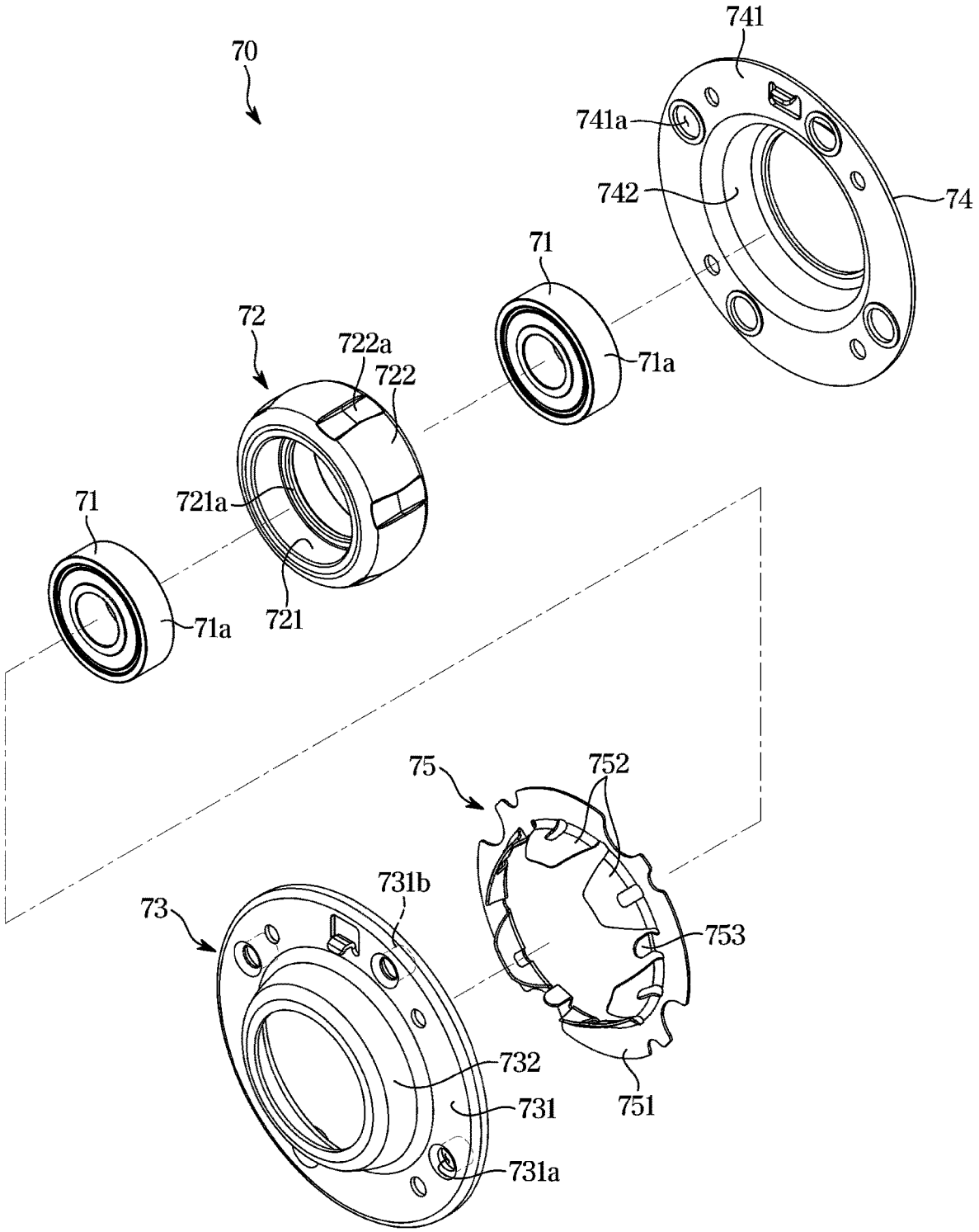
FIG. 6 is an exploded perspective view of the bearing assembly in the clothes dryer according to an embodiment of the disclosure.

Referring to FIGS. 5 and 6, the shaft 33 is rotatably installed on the rear plate 15 through the bearing assembly 70.

The bearing assembly 70 includes a bearing 71 through which the shaft 33 is installed to pass, a centering guide 72 formed in an annular shape and in which the bearing 71 is installed, a first centering housing 73 and a second centering housing 74 which are coupled to each other in a front-rear direction to accommodate the centering guide 72 to be moved therein, and an elastic member 75 configured to elastically support the centering guide 72.

The bearing 71 is formed in an annular shape, and in which the shaft 33 is installed to penetrate. The bearing 71 rotatably supports the shaft 33. The bearing 71 includes a bearing housing 71*a* formed in a hollow ring shape, and a plurality of balls 71*b* rotatably installed in the bearing housing 71*a*.

Two bearings 71 are provided on opposite inner sides of the centering guide 72. However, the number of bearing is not limited thereto, and a single bearing may be installed in the centering guide 72.

Further, the bearing 71 is formed with a ball bearing but this is merely an example and is not limited thereto. That is, in addition to the ball bearings, various kinds of bearings such as roller bearings may be used for supporting the shaft 33.

The centering guide 72 is installed to be rotatable in the front, rear, left, and right directions in a space between the first centering housing 73 and the second centering housing 74. The centering guide 72 prevents a heavy load from acting on the shaft 33 by allowing the inclination of the shaft 33 to be varied in the front, rear, left, and right directions within a setting range.

The centering guide 72 includes an outer circumferential surface formed with a spherical surface. The centering guide 72 includes a fixing member 721 formed in an annular shape and in which the bearing 71 is fixed, and a guide member 722 formed in an annular shape and in which the fixing member 721 is fixed. The guide member 722 is integrally formed on the outside of the fixing member 721 through the insert injection molding method, and the outer circumferential surface of the guide member 722 is formed with a spherical surface.

The fixing member 721 is formed of a metal material so as to stably support the bearing 71. The fixing member 721 includes a partition protrusion 721*a* protruding from the center of the inner circumferential surface of the fixing member 721 and extending in the circumferential direction to partition a space in which the bearings 71 are installed. The two bearings 71 are installed at opposite inner sides of the fixing member 721 about the partition protrusion 721*a*.

Figure 7:
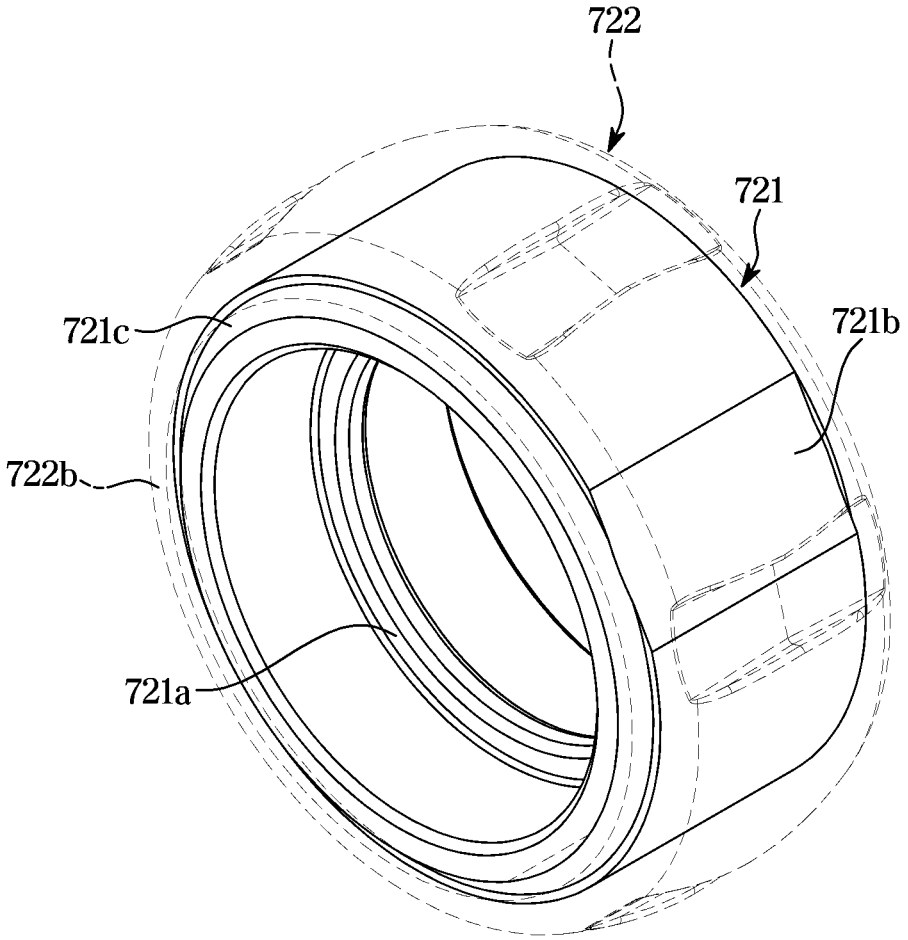
FIG. 7 is a perspective view of a centering guide in the clothes dryer according to an embodiment of the disclosure.

As illustrated in FIG. 7, the fixing member 721 includes a chamfered portion 721*b* formed by processing a portion of the outer circumferential surface of the fixing member 721 to be a plane. Therefore, by the chamfered portion 721*b*, it is possible to prevent separation of the fixing member 721 and the guide member 722 in the circumferential direction.

The fixing member 721 includes a pair of stepped portions 721*c* formed in a concave shape at axial opposite ends of the outer circumferential surface of the fixing member 721. The guide member 722 includes a pair of catching portions 722*b* formed in a convex shape at axial opposite ends in an inner circumferential surface of the guided member 722 to be caught by the pair of stepped portions 721*c*. Thus, it is possible to prevent separation of the fixing member 721 and the guide member 722 in the axial direction by the pair of stepped portions 721*c* and the pair of catching portions 722*b*.

The guide member 722 is formed of lubricating resin so that the centering guide 72 may easily move along the inner surface of the centering housings 73 and 74. The guide member 722 is formed by mixing Teflon having lubricity with Polyoxymethylene (POM) resin having excellent abrasion resistance. Accordingly, the guide member 722 has excellent wear resistance and lubricity.

Therefore, the bearing 71 may be stably fixed through the fixing member 721 formed of a metal material, and the centering guide 72 may be easily rotated in the front, rear, left, and right directions through the guide member 722 formed of a resin material having lubricity.

The guide member 722 includes a locking groove 722*a* extending in the axial direction on an outer circumferential surface thereof that is the outer circumferential surface of the centering guide 72, and configured to be locked by a locking portion 753 of the elastic member 75. A plurality of locking grooves 722*a* is provided on the outer circumferential surface of the guide member 722 and spaced apart from each other in the circumferential direction.

Referring to FIGS. 5 and 6, the first centering housing 73 includes a first flange 731 formed in annular shape, and a first guide portion 732 extending to the front side from the inner end of the first flange 731 to accommodate a front end portion of the centering guide 72. The second centering housing 74 includes a second flange 741 formed with an annular plate, and a second guide portion 742 extending to the rear side from the inner end of the second flange 741 to accommodate the rear end portion of the centering guide 72.

The first flange 731 includes a first through hole 731*a* formed in a circular shape, and a fixing rib 731*b* formed in an annular shape and extending from the inner end of the first through hole 731*a* to the rear side. A plurality of first through holes 731*a* and fixing ribs 731*b* are provided and spaced apart from each other in the circumferential direction.

The second flange 741 includes a second through hole 741*a* formed in a circular shape. A plurality of second through holes 741*a* is provided to be spaced apart from each other in the circumferential direction and the plurality of second through holes 741*a* is formed at positions corresponding to the first through holes 731*a*. The second through hole 741*a* is formed to have a larger diameter than the fixed rib 731*b* so that the fixing rib 731*b* may penetrate through the second through hole 741*a* and the rear end thereof may protrude to the rear side.

Figure 8:
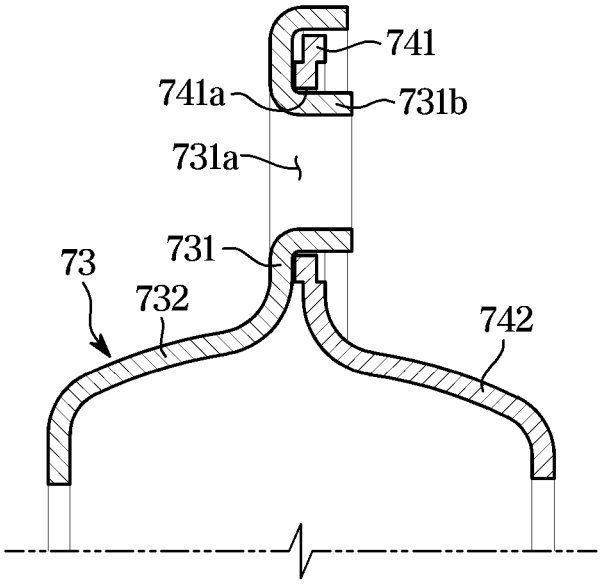
FIG. 8 is a schematic view illustrating a coupling process of a first centering guide and a second centering guide in the clothes dryer according to an embodiment of the disclosure.
Figure 9:
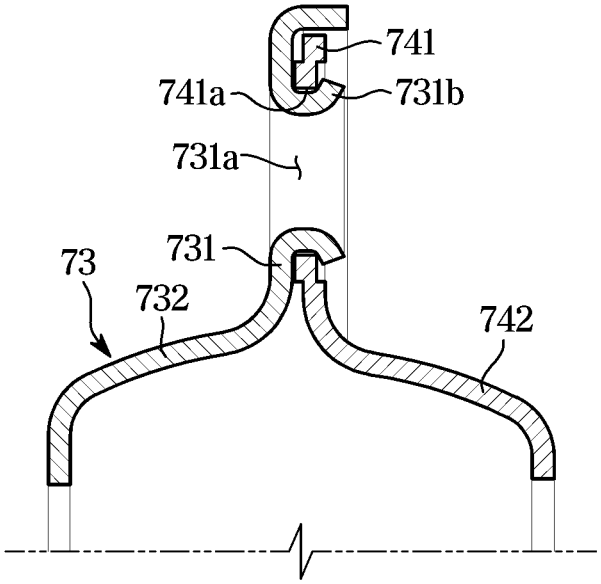
FIG. 9 is a schematic view illustrating the coupling process of the first centering guide and the second centering guide in the clothes dryer according to an embodiment of the disclosure.

Therefore, as illustrated in FIG. 8, the fixing ribs 731*b* are installed to pass through the second through holes 741*a*, and then the rear end of the fixing ribs 731*b* is deformed by a curling process, as illustrated in FIG. 9. The rear end of the fixing ribs 731*b* are supported by the rear surface of the second flange 741 adjacent to the second through hole, and thus the coupling between the first centering housing 73 and the second centering housing 74 is completed. Therefore, the first centering housing 73 and the second centering housing 74 may be coupled to each other without a separate fastening member.

As illustrated in FIG. 5, the outer circumferential surface of the first guide portion 732 and the outer circumferential surface of the second guide portion 742 are formed with a spherical shape so as to correspond to the outer circumferential surface of the centering guide 72. The inner circumferential surface of the first guide portion 732 is formed with a spherical surface corresponding to the front outer circumferential surface of the centering guide 72, and the inner circumferential surface of the second guide portion 742 is formed with a spherical surface corresponding to the rear outer circumferential surface of the centering guide 72. Therefore, the centering guide 72 may be rotated in the front, rear, left, and right directions along the inner circumferential surfaces of the first centering housing 73 and the second centering housing 74.

As illustrated in FIGS. 5 and 6, the elastic member 75 includes a base portion 751, a plurality of elastic portion 752 extending from the inner end of the base portion 751, and a plurality of locking portions 753 extending from the inner end of the base portion 751.

The base portion 751 is fitted and fixed between the first flange 731 and the second flange 741 while the first centering housing 73 and the second centering housing 74 are coupled to each other. Therefore, it is possible to prevent the elastic member 75 from rotating in the circumferential direction.

The plurality of elastic portions 752 is spaced apart from each other in the circumferential direction and elastically supported on the outer circumferential surface of the centering guide 72 formed with a spherical shape. The elastic portions 752 are elastically supported on the front outer circumferential surface of the centering guide 72 to elastically support the centering guide 72 to the rear side.

The plurality of locking portions 753 is spaced apart from each other in the circumferential direction and inserted into the locking grooves 722*a* of the guide member 722. Therefore, by the locking groove 722*a* and the locking portion 753, it is possible to prevent the centering guide 72 from rotating in the circumferential direction.

Hereinafter a manufacturing method of a bearing assembly applied to the clothes dryer according to an embodiment of the disclosure will be described.

First, the fixing member 721 formed in an annular shape and formed of a metal material is manufactured. In the process of manufacturing the fixing member 721, the chamfered portion 721*b* and the stepped portion 721*c* are formed on the outer circumferential surface of the fixing member 721.

Next, the centering guide 72 is manufactured by forming the guide member formed of the resin material on the outer side of the fixing member 721 through the insert injection molding method. By the chamfered portion 721*b*, the separation of the fixing member 721 and the guide member 722 in the circumferential direction is prevented. Further, the separation of the fixing member 721 and the guide member 722 in the axial direction is prevented by the stepped portion 721*c* and axial opposite end portions of the guide member 722 configure to cover the stepped portion 721*c*.

After the manufacture of the centering guide 72 is completed, two bearings 71 are fixed to the inside of the centering guide 72 that is the opposite inner sides of the centering guide 72. The bearings 71 are pressed and fixed to opposite inner sides of the fixing member 721.

Because the bearings 71 are installed and used in the centering guide 72 as described above, various types of bearings 71 having excellent mechanical characteristics may be installed and used in the centering guide 72. That is, the bearing assembly 70 having a centering function may be easily manufactured by using a bearing 71 which is generally used.

After arranging the centering guide 72, in which the bearing 71 is installed, and the elastic member 75 between the first centering housing 73 and the second centering housing 74, the first centering housing 73 and the second centering housing 74 are coupled to each other.

The fixing ribs 731*b* are installed to pass through the second through holes 741*a*, and then the rear end of the fixing ribs 731*b* is deformed by the curling process and thus the rear end of the fixing rib 731*b* is supported by the rear surface of the 741 adjacent to the second through hole. Accordingly, the coupling of the first centering housing 73 and the second centering housing 74 is completed.

Because the base portion 751 of the elastic member is fitted and fixed between the first flange 731 and the second flange 741 in the process of coupling the first centering housing 73 and the second centering housing 74, it is possible to prevent the rotation of the elastic member 751 in the circumferential direction. Further, the locking portion 753 of the elastic member 75 is locked to the locking groove 722*a* of the outer circumferential surface of the guide member 722. Therefore, the centering guide 72 may move only in the front, rear, left, and right directions, without rotating in the circumferential direction.

The first centering housing 73 and the second centering housing 74 are coupled to each other as mentioned above, and then the manufacturing of the bearing assembly 70 is completed.

After the manufactured bearing assembly 70 is fixed to the rear plate 15 of the housing 10 through the fastening members, the shaft 33 is installed to penetrate the inside of the bearings 71. Next, by fastening the nut 35 to the rear end of the shaft 33, the drum 30 is rotatably installed in the housing 10 through the bearing assembly 70.

As is apparent from the above description, the bearing assembly and the clothes dryer including the same may prevent an excessive load from being applied to the shaft although the unbalanced load is applied to the drum.

The bearing assembly and the clothes dryer including the same may simply manufacture the bearing assembly having a centering function using a bearing that is generally used.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes dryer comprising:

a housing;

a drum configured to be rotatable in the housing;

a shaft connected to drum to rotate the drum and installed at a center of a rear wall of the drum; and a bearing assembly configured to rotatably support the shaft, wherein the bearing assembly comprises:

a bearing configured to rotatably support the shaft; and a centering guide formed in an annular shape and in which the bearing is installed, wherein the centering guide allows an inclination of the shaft to be varied in front, rear, left, and right directions, the centering guide comprises an outer circumferential surface formed with a spherical surface, and the centering guide comprises:

a fixing member formed in an annular shape and disposed on outside of the bearing in a radial direction of the annular shape, and the bearing being fixed to the fixing member; and a guide member formed in an annular shape, disposed on outside of the fixing member in the radial direction to allow the fixing member to be fixed therein, and provided with an outer circumferential surface formed with a spherical surface.

2. The clothes dryer of claim 1, wherein the bearing is one of a pair of bearings provided in the bearing assembly and the pair of bearings is to be fixed to opposite inner sides of the centering guide.

3. The clothes dryer of claim 1, wherein the fixing member is formed of a metal material, and the guide member is formed of a resin material through the insert injection molding method.

4. The clothes dryer of claim 3, wherein the fixing member comprises at least one chamfered portion formed by processing a portion of an outer circumferential surface to be a plane.

5. The clothes dryer of claim 3, wherein the fixing member comprises a pair of stepped portions formed in a concave shape at axial opposite ends of the outer circumferential surface of the fixing member, and the guide member comprises a pair of catching portions formed in a convex shape at axial opposite ends in an inner circumferential surface of the guided member to be caught by the pair of stepped portions.

6. The clothes dryer of claim 1, wherein the bearing assembly further comprises a first centering housing and a second centering housing coupled to each other in a front-rear direction and having the centering guide between the first centering housing and the second centering housing so that the centering guide is rotatable inside the coupled first and second centering housings.

7. The clothes dryer of claim 6, wherein the first centering housing comprises a first guide portion comprising an inner circumferential surface formed with a spherical surface corresponding to a front outer circumferential surface of the centering guide, and the second centering housing comprises a second guide portion comprising an inner circumferential surface formed with a spherical surface corresponding to a rear outer circumferential surface of the centering guide.

8. The clothes dryer of claim 7, wherein the first centering housing comprises a first flange formed with an annular plate and in which the first guide portion extends from an inner end thereof, and the second centering housing comprises a second flange formed with an annular plate and in which the second guide portion extends from an inner end thereof.

9. The clothes dryer of claim 7, wherein the first centering housing comprises a first through hole provided in the first flange and a fixing rib extending from an inner end of the first through hole, and the second centering housing comprises a second through hole provided on the second flange to correspond to the fixing rib, and wherein the second through hole is formed to have a diameter larger than that of the fixing rib, and a rear end of the fixing rib is curled after passing through the second through hole, so as to be supported on the second flange.

10. The clothes dryer of claim 6, further comprising:

an elastic member arranged between the first and second centering housings to elastically support the centering guide.

11. The clothes dryer of claim 10, wherein the elastic member comprises a base portion formed with an annular plate and fitted between the first and second centering housings, and a plurality of elastic portions extending from an inner end of the base portion and spaced apart from each other in the circumferential direction.

12. The clothes dryer of claim 11 wherein the centering guide comprises a plurality of locking grooves formed on the outer circumferential surface in the axial direction and spaced apart from each other in the circumferential direction, and the elastic member further comprises a plurality of locking portions extending from the inner end of the base portion to be locked by the plurality of locking grooves.

13. A bearing assembly comprising:

a bearing configured to rotatably support a shaft;

a centering guide formed in an annular shape and in which the bearing is installed; and a first centering housing and a second centering housing coupled to each other in a front-rear direction to receive the centering guide therein and the centering guide being configured to be rotatable therein so that the centering guide allows an inclination of the shaft to be varied in front, rear, left, and right directions, wherein the centering guide comprises an outer circumferential surface formed with a spherical surface, the first centering housing comprises a first guide portion comprising an inner circumferential surface formed with a spherical surface corresponding to a front outer circumferential surface of the centering guide, the second centering housing comprises a second guide portion comprising an inner circumferential surface formed with a spherical surface corresponding to a rear outer circumferential surface of the centering guide, and the centering guide further comprises a fixing member formed in an annular shape and to which the bearing is fixed, and a guide member formed in an annular shape to allow the fixing member to be fixed therein and provided with an outer circumferential surface formed with a spherical surface.

14. The bearing assembly of claim 13, wherein the fixing member comprises at least one chamfered portion formed by processing a portion of an outer circumferential surface to be a plane, and the guide member is formed on the outside of the fixing member through the insert injection molding method.

15. The bearing assembly of claim 13, wherein the fixing member comprises a stepped portion formed in a concave shape at axial opposite ends of the outer circumferential surface, and the guide member is formed on the outside of the fixing member through the insert injection molding method.

16. The bearing assembly of claim 13, further comprising:

an elastic member arranged between the first and second centering housings to elastically support the centering guide.

17. The bearing assembly of claim 16, wherein the elastic member comprises a base portion formed with an annular plate and fitted between the first and second centering housings, and a plurality of elastic portions extending from an inner end of the base portion and spaced apart from each other in the circumferential direction.

18. The bearing assembly of claim 17, wherein the centering guide comprises a plurality of locking grooves formed on the outer circumferential surface in the axial direction and spaced apart from each other in the circumferential direction, and the elastic member further comprises a plurality of locking portions extending from the inner end of the base portion to be locked by the plurality of locking grooves.

* * * * *